US008225438B2

(12) United States Patent
Murphy

(10) Patent No.: US 8,225,438 B2
(45) Date of Patent: Jul. 24, 2012

(54) SEATING UNIT CONVERTIBLE TO BED

(75) Inventor: Marcus L. Murphy, Lexington, NC (US)

(73) Assignee: Ultra-Mek, Inc., Denton, NC (US)

( * ) Notice: Subject to any disclaimer, the term of this patent is extended or adjusted under 35 U.S.C. 154(b) by 1075 days.

(21) Appl. No.: 11/322,638

(22) Filed: Dec. 30, 2005

(65) Prior Publication Data

US 2007/0151023 A1 Jul. 5, 2007

(51) Int. Cl.
*A47C 17/16* (2006.01)

(52) U.S. Cl. ..... 5/13; 5/36; 5/42.1

(58) Field of Classification Search ..... 5/42.1, 5/13, 36

See application file for complete search history.

(56) References Cited

U.S. PATENT DOCUMENTS

| | | | | | |
|---|---|---|---|---|---|
| 1,180,926 | A | * | 4/1916 | Jeffcott | 5/42.1 |
| 1,903,918 | A | * | 4/1933 | Fraser et al. | 5/42.1 |
| 2,876,461 | A | | 3/1959 | Bontempi | |
| 3,908,210 | A | | 9/1975 | Alembik | |
| 4,402,096 | A | * | 9/1983 | Atimichuk | 5/17 |
| 4,625,346 | A | * | 12/1986 | Quackenbush | 5/37.1 |
| 4,737,996 | A | | 4/1988 | Tiffany | |
| 5,195,194 | A | * | 3/1993 | Bradley et al. | 5/37.1 |

OTHER PUBLICATIONS

Cover of *Highpoints* publication, Tiffany Sleeper, Market Introductions (Apr. 2000).
Cover of *The Philadelphia Inquirer*, Home and Design Section (Apr. 21, 2000).
*UDM Design News*, p. 32 (Jun. 2000).
*Home & Garden, Sun-Sentinel*, p. 3E (South Florida, Apr. 14, 2000).
*Functional upholstery takes center stage, Furniture Today*, vol. 24, No. 30d, 2 pages (Apr. 9, 2000).
Photograph 1, Version 1, sofa shown at trade show in San Francisco, folding center leg and Version 1 front leg actuator (Jan. 2000).
Photograph 2, Version 1, sofa shown at trade show in San Francisco, sofa partially opened (Jan. 2000).
Photograph 3, Version 1, sofa shown at trade show in San Francisco, sofa completely opened (Jan. 2000).
Photograph 4, Version 1, sofa shown at trade show in San Francisco, tube assembly front pivot offset and extended and folding center leg extended (Jan. 2000).

(Continued)

*Primary Examiner* — Michael Trettel
*Assistant Examiner* — William Kelleher
(74) *Attorney, Agent, or Firm* — Myers, Bigel, Sibley & Sajovec

(57) ABSTRACT

A seating unit convertible into a bed includes: a base configured to rest on an underlying surface; a rear support pivotally interconnected with the base; a backrest having a backrest cushion; a seat having a seat cushion; a seat carriage; and a folding mechanism attached to the rear support, backrest and seat. The folding mechanism comprises a plurality of pivotally interconnected links that are configured and arranged to move the rear support, backrest and seat between a folded position, in which the rear support is generally upright, the backrest is generally upright and positioned forwardly of the rear support, the seat is generally horizontal and positioned forwardly of the backrest, and the seat carriage is positioned above the base and below the seat, and an unfolded position, in which the rear support, the backrest, and the seat are substantially horizontal and serially aligned with each other, the rear support is above the base, and the seat carriage is positioned below the seat and forward of the base.

20 Claims, 7 Drawing Sheets

OTHER PUBLICATIONS

Photograph 5, Version 1, sofa shown at trade show in San Francisco, folding center leg extended and front wood leg with Version 1 of front leg actuator (Jan. 2000).

Photograph 6, Version 2, sofa shown at trade show in High Point, folding center leg extended and metal tube front leg with version 2 of front leg actuator (Apr. 2000).

Photograph 7, Version 2, sofa shown at trade show in High Point , metal tube front leg with Version 2 of front leg actuator and folding center leg extended (Apr. 2000).

Photograph 8, Version 2, sofa shown at trade show in High Point, metal tube front leg with Version 2 of from leg actuator and folding center leg extended (Apr. 2000).

Photograph 9, Versions 1 and 2, tube assembly front pivot (offset & extended).

Photograph 10, Versions 1 and 2, inside arm spring assist.

Photograph 11, Versions 1 and 2, inside arm spring assist.

Photograph 12, Versions 1 and 2, inside arm spring assist.

stawett catalog 2003/2004.

LUSCH catalog ’03/’04.

* cited by examiner

SEATING UNIT CONVERTIBLE TO BED

FIELD OF THE INVENTION

The present invention relates generally to a sofa or other seating unit that is convertible into a bed, and relates more specifically to a seating unit that has backrest and seat sections that form portions of the bed.

BACKGROUND OF THE INVENTION

Seating units that are convertible into beds are popular with consumers because of their multifunctionality. Many consumers find it very convenient to have a sofa or chair that can provide a bed for a guest, as such a unit can eliminate the need for an additional, separate bed. One popular sofa-bed design includes its own complete mattress that is folded within the cavity of the sofa during periods of non-use. One such example is illustrated in U.S. Pat. No. 4,200,941 to Gill et al. This type of sofa-bed can be quite heavy, and typically requires not only the separate mattress, but also a relatively intricate mechanism to control the unfolding and folding of the mattress.

Other sofa-beds lack a complete mattress, but instead are constructed of separate sections that serve as support surfaces of the sofa and unfold to form a flat, mattress-like sleeping surface. An example of a convertible sofa of this type is illustrated in U.S. Pat. No. 4,737,996 to Tiffany. The Tiffany sofa-bed includes a backrest, a seat and a "subseat" that unfold to form the horizontal sleeping surface. In the folded "sofa" configuration, the backrest is generally upright, and the seat and "subseat" fold upon each other (with the subseat in an inverted position). The backrest is guided between positions by preformed slots in the arms of the sofa that receive posts that extend laterally from the backrest. The backrest is coupled to the seat and subseat via an angled link. The subseat is pivotally attached at one end to the arms and is hinged at the other end to the seat. This arrangement is described in Tiffany as being particularly economical and having relatively few moving parts.

Convertible beds are popular in health care environments (e.g., hospitals), because they provide a family member visiting a patient with a furniture piece in the patient's room on which one can either sit or sleep. Because hospital rooms are typically short on available space, convertible beds used in hospital rooms are typically the width of a chair. Generally speaking, hospitals prefer chairs without arms, as this prevents visitors from sitting on the arms, which increases the risk of the chair tipping over or the arms breaking off of the chair.

SUMMARY OF THE INVENTION

As a first aspect, embodiments of the present invention are directed to a seating unit convertible into a bed. The seating unit comprises: a base configured to rest on an underlying surface; a rear support pivotally interconnected with the base; a backrest having a backrest cushion; a seat having a seat cushion; a seat carriage; and a folding mechanism attached to the rear support, backrest and seat. The folding mechanism comprises a plurality of pivotally interconnected links that are configured and arranged to move the rear support, backrest and seat between a folded position, in which the rear support is generally upright, the backrest is generally upright and positioned forwardly of the rear support, the seat is generally horizontal and positioned forwardly of the backrest, and the seat carriage is positioned above the base and below the seat, and an unfolded position, in which the rear support, the backrest, and the seat are substantially horizontal and serially aligned with each other, the rear support is above the base, and the seat carriage is positioned below the seat and forward of the base. In this configuration, the seating unit can provide a comfortable sitting surface that can be easily converted into a sleeping surface.

As a second aspect, embodiments of the present invention are directed to a seating unit convertible into a bed, comprising: a base configured to rest on an underlying surface; a rear support pivotally interconnected with the base; a backrest having a backrest cushion; a seat having a seat cushion; a seat carriage; and a folding mechanism attached to the rear support, backrest and seat. The folding mechanism comprises a plurality of pivotally interconnected links that are configured and arranged to move the rear support, backrest and seat between a folded position, in which the rear support is generally upright, the backrest is generally upright and positioned forwardly of the rear support, the seat is generally horizontal and positioned forwardly of the backrest, and the seat carriage is positioned above the base and below the seat, and an unfolded position, in which the rear support, the backrest, and the seat are substantially horizontal and serially aligned with each other, the rear support is above the base, and the seat carriage is positioned below the seat and forward of the base. The rear support includes a frame, and the frame and the base are devoid of arms. In this armless configuration, the seating unit may be particularly desirable for use in a hospital setting.

As a third aspect, embodiments of the present invention are directed to a seating unit convertible into a bed, comprising: a base configured to rest on an underlying surface; a rear support pivotally interconnected with the base; a backrest having a backrest cushion; a seat having a seat cushion; a seat carriage; and a folding mechanism attached to the rear support, backrest and seat. The folding mechanism comprises a plurality of pivotally interconnected links that are configured and arranged to move the rear support, backrest and seat between a folded position, in which the rear support is generally upright, the backrest is generally upright and positioned forwardly of the rear support, the seat is generally horizontal and positioned forwardly of the backrest, and the seat carriage is positioned above the base and below the seat, and an unfolded position, in which the rear support, the backrest, and the seat are substantially horizontal and serially aligned with each other, the rear support is above the base, and the seat carriage is positioned below the seat and forward of the base. The folding mechanism is configured such that a front edge of the rear support and a rear edge of the backrest are adjacent to each other in the folded and unfolded position; the folding mechanism is devoid of a hinge that directly pivotally interconnects the rear support and the backrest. This configuration can provide an attractive appearance to the abutting upper edges of the rear support and the backrest.

As a fourth aspect, embodiments of the present invention are directed to a seating unit convertible into a bed, comprising: a base configured to rest on an underlying surface; a rear support pivotally interconnected with the base; a backrest having a backrest cushion; a seat having a seat cushion; a seat carriage having a storage cavity; and a folding mechanism attached to the rear support, backrest and seat. The folding mechanism comprises a plurality of pivotally interconnected links that are configured and arranged to move the rear support, backrest and seat between a folded position, in which the rear support is generally upright, the backrest is generally upright and positioned forwardly of the rear support, the seat is generally horizontal and positioned forwardly of the backrest, and the seat carriage is positioned above the base and below the seat, and an unfolded position, in which the rear support, the backrest, and the seat are substantially horizontal and serially aligned with each other, the rear support is above the base, and the seat carriage is positioned below the seat and forward of the base. The seat can be moved away from the seat carriage for accessing the storage cavity (in some embodiments, the seat is attached to the seat carriage with a lifting mechanism).

As a fifth aspect, embodiments of the present invention are directed to a seating unit convertible into a bed, comprising: a base configured to rest on an underlying surface; a rear support pivotally interconnected with the base; a backrest having a backrest cushion; a seat having a seat cushion; a seat carriage; and a folding mechanism attached to the rear support, backrest and seat. The folding mechanism comprises a plurality of pivotally interconnected links that are configured and arranged to move the rear support, backrest and seat between a folded position, in which the rear support is generally upright, the backrest is generally upright and positioned forwardly of the rear support, the seat is generally horizontal and positioned forwardly of the backrest, and the seat carriage is positioned above the base and below the seat, and an unfolded position, in which the rear support, the backrest, and the seat are substantially horizontal and serially aligned with each other, the rear support is above the base, and the seat carriage is positioned below the seat and forward of the base. The seating unit further comprises a locking mechanism mounted to the seat carriage and to the base that releasably locks the seating unit in the folded position.

DETAILED DESCRIPTION OF EMBODIMENTS OF THE INVENTION

Figure 1:
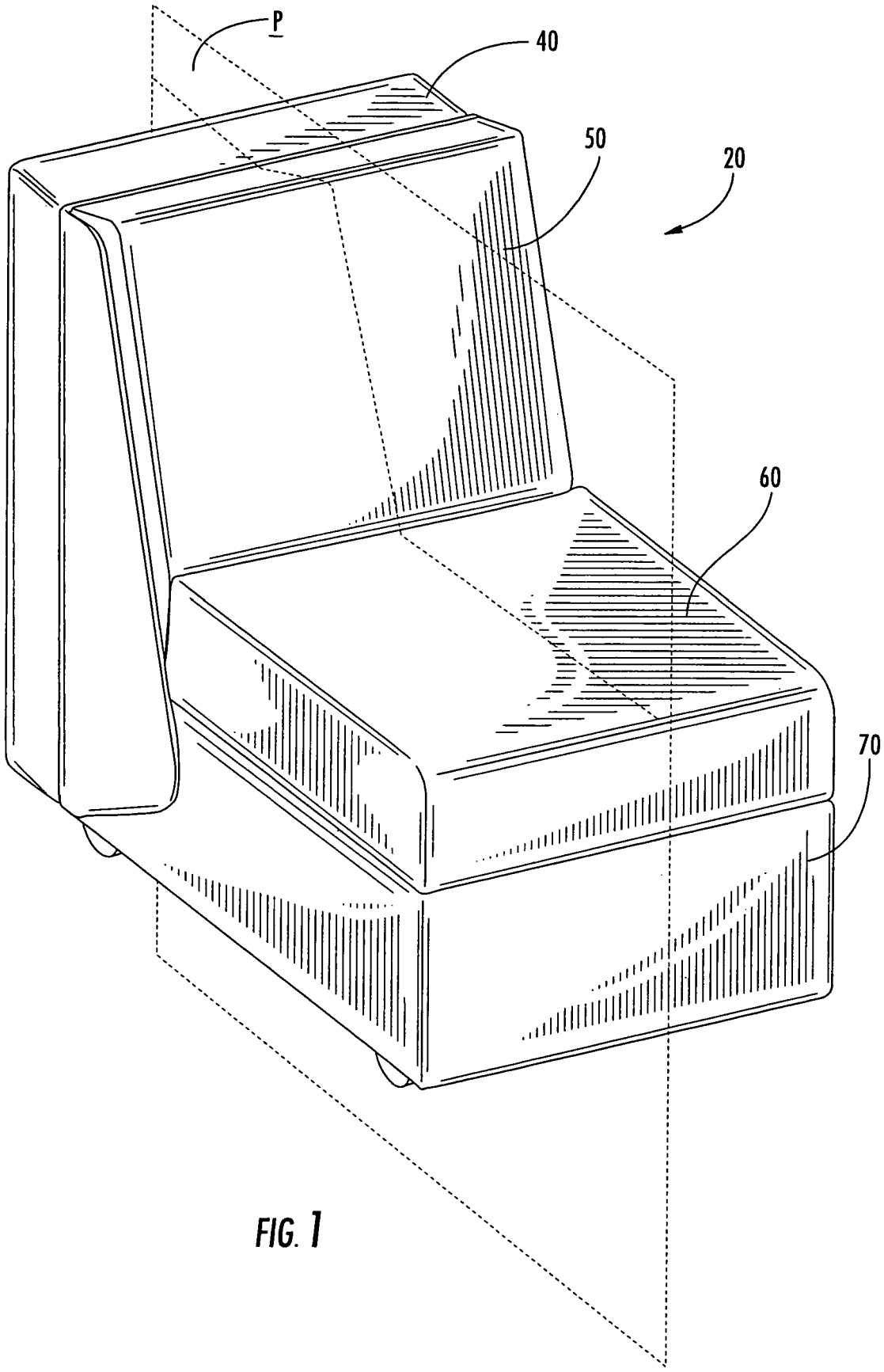
FIG. 1 is a perspective view of a convertible chair-bed according to embodiments of the present invention, with the bed shown in the folded position.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity. Well-known functions or constructions may not be described in detail for brevity and/or clarity.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Referring now to the figures, a chair-bed, designated broadly at 20, is illustrated in FIG. 1. The chair-bed 20 includes a base 22 (shown in FIG. 2), a rear support 40, a backrest 50, a seat 60, and a seat carriage 70. The chair-bed 20 is movable between (a) a folded position (shown in FIG. 2), in which the rear support 40 is generally upright, the backrest 50 is generally upright and positioned forwardly of the rear support 40, the seat 60 is generally horizontal and positioned forwardly of the backrest 50, and the seat carriage 70 is positioned above the base 22 and below the seat 60, and (b) an unfolded position (shown in FIG. 3), in which the rear support 40, the backrest 50, and the seat 60 are substantially horizontal and serially aligned with each other, the rear support 40 is above the base 22, and the seat carriage 70 is positioned below the seat 60 forward of the base 22. A folding mechanism 80 (seen in FIGS. 2 and 3) controls the relative movement of these components.

The components identified above are described in greater detail below. For the sake of clarity, the chair-bed 20 will be described initially in the unfolded position of FIG. 3; movement to the folded position of FIG. 2 will then follow. As used herein to describe the relative positions of components, the terms "lateral", "outward" and derivatives thereof indicate the directions defined by a vector beginning at a vertical plane P (shown in FIG. 1) that bisects the chair-bed 20 normal to the rear support 40 and extending normal thereto. Conversely, the terms "inward", "inboard" and derivatives thereof indicate the direction opposite the "outward" direction. Together, the "inward" and "outward" directions comprise the "transverse" axis of the chair-bed 20. The "rear" of the unfolded chair-bed 20 is located at the end of the chair-bed 20 nearest the rear support 40, and the "front" of the chair-bed 20 is located at the end nearest the seat 60. The "front" and "rear" directions comprise the "longitudinal" axis of the chair-bed 20. The "head" of the unfolded chair-bed 20 is the end formed by the rear support 40, and the "foot" of the unfolded chair-bed 20 is the end formed by the seat 60.

In addition, some components of the sofa-bed 20 (particularly the folding mechanism 80) are illustrated herein as a series of pivotally interconnected links. Those skilled in this art will appreciate that the pivots between links or other components can take a variety of configurations, such as pivot pins, rivets, bolt and nut combinations, and the like, any of which may be suitable for use with the present invention. Also, the shapes and configurations of the links themselves may vary, as will be understood by those skilled in this art. Further, some links may be omitted entirely in some embodiments, and additional links may be included in some embodiments.

Figure 3:
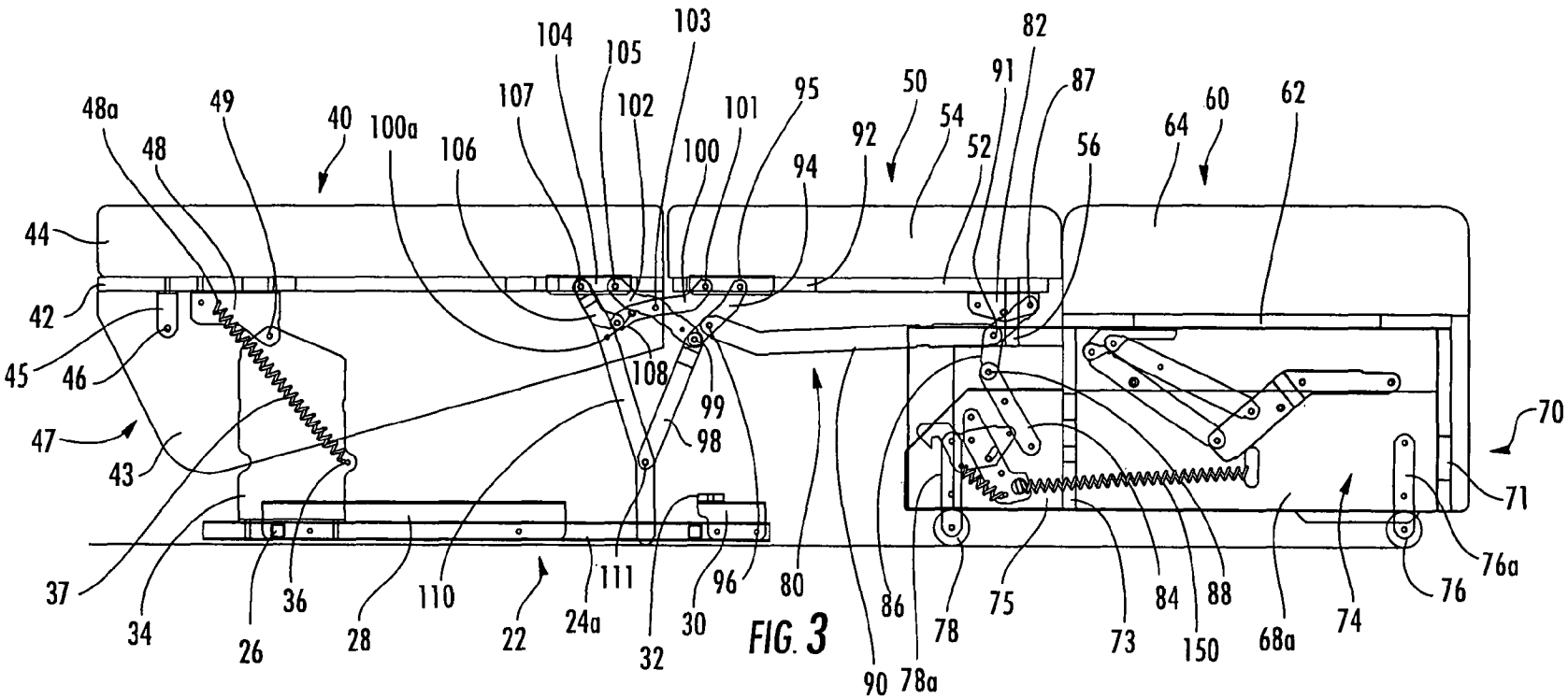
FIG. 3 is a side section view of the chair-bed of FIG. 1, with the chair-bed shown in the unfolded position.
Figure 5:
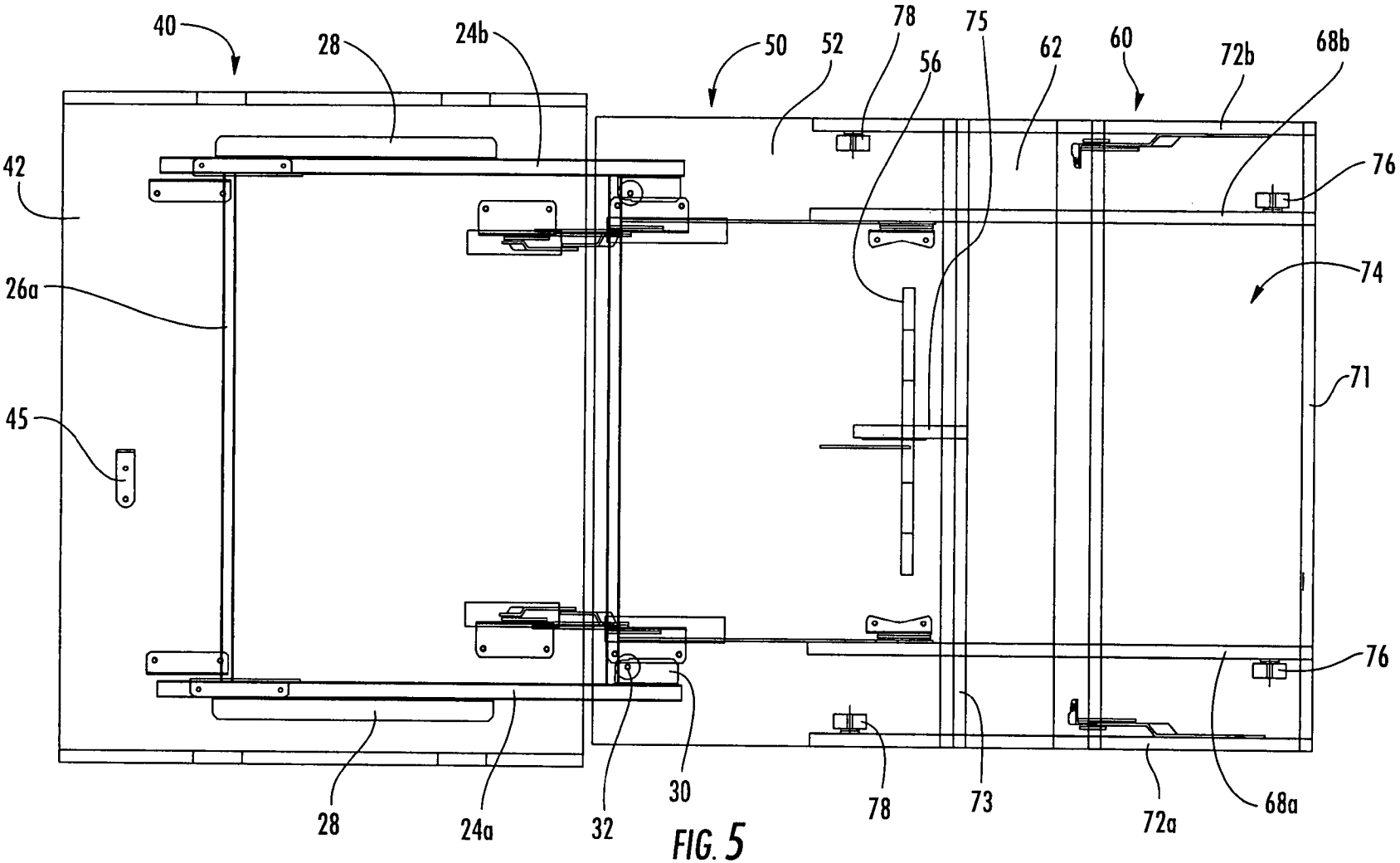
FIG. 5 is a cutaway top view of the chair-bed of FIG. 1, with the chair-bed shown in the unfolded position.

Referring now to FIGS. 3 and 5, the base 22 includes a pair of longitudinally-extending side rails 24*a*, 24*b* that are spanned by front and rear cross-members 26*a*, 26*b*. A rear wheel shield 28 is attached to the outboard side of each of the side rails 24*a*, 24*b* and extends over much of the length thereof. A front wheel shield 30 is attached to the forward portion of each side rail 24*a*, 24*b* on the inboard side thereof. A roller 32 is rotatably mounted to each front wheel shield 30 for rotation about a vertical axis. A mounting plate 34 is mounted to the inboard side of each side rail 24*a*, 24*b* and extends upwardly therefrom. A hole 36 is present in an nub projecting from a forward edge of the mounting plate 34 for the mounting of a spring 37, as described below.

Those skilled in this art will appreciate that the base 22 may take other configurations. As one example, the base may have additional rails and/or cross members, or fewer of each. The wheel shields 28, 30 may be omitted in some embodiments, as may be the rollers 32. Other variations will be apparent to those skilled in this art.

Referring again to FIG. 3, the rear support 40 includes a panel 42 (which is horizontally disposed in FIG. 3) and a cushion 44 (typically upholstered) that is attached to and overlies the panel 42. Side panels 43 depend from each lateral edge of the panel 42; the side panels 43 are also typically upholstered. Together the side panels 43 and panel 42 form a frame 47 which, in this embodiment, is devoid of arms (as is the base 22), which can be desirable in certain styles of chairs (such as health care chairs). A locking pin 46 is mounted on a bracket 45 that extends downwardly from a rear portion of the panel 42. Mounting brackets 48 are mounted to the underside of the panel 42 and extend downwardly therefrom to pivots 49 with the mounting plates 34 of the base 22 that, in this embodiment, directly pivotally interconnect the rear support 40 with the base 22. The mounting bracket 48 also includes a hole 48*a* that receives the upper end of the spring 37, which is in tension when the chair-bed 20 is in the unfolded position illustrated in FIG. 3.

Those skilled in this art will recognize that other configurations for the rear support 40 may be suitable for use with the present invention. For example, the side panels 43 may be shaped differently, or they may include arms. The panel 42 may be a solid piece, or may be an open frame. The mounting brackets 48 may be replaced with brackets of other shapes, or may be omitted. The rear support 40 may be indirectly connected with the base 22. Other variations will be apparent to those skilled in this art.

Referring once again to FIG. 3, the backrest 50 includes a substantially horizontal panel 52 that underlies a cushion 54 (typically upholstered). A transversely-mounted spacing panel 56 extends downwardly from the underside of a front portion of the panel 52. The seat 60 includes a substantially horizontal panel 62 and an overlying cushion 64.

Those skilled in this art will recognize that other configurations for the backrest 50 and seat 60 may be suitable for use with the present invention. As an example, either or both of the panels 52, 62 may be a solid piece, or may be an open frame.

Referring yet again to FIG. 3, the seat carriage 70 includes a front wall 71, side walls 72*a*, 72*b*, and a rear wall 73, thereby defining a storage cavity 74. A vertically-disposed central support beam 75 extends rearwardly from the rear wall 73 and underlies and supports the spacing panel 56 of the backrest 50. Upright guides 68*a*, 68*b* are mounted to the front wall 71 and extend longitudinally rearward therefrom. Front wheels 76 are mounted to the outboard surfaces of the guides 68*a*, 68*b* via brackets 76*a*, and rear wheels 78 are mounted to the inboard surfaces of the side walls 72*a*, 72*b* via brackets 78*a*.

Those skilled in this art will recognize that the seat carriage 70 may take other configurations. For example, the storage cavity 74 may be shaped differently, or may be omitted. The front wheels may be replace with other components, such as skid plates or the like, that can move easily across a flat surface. The guides and central support beam may also have different shapes or may be omitted.

The folding mechanisms 80 are mirror images of one another about the aforementioned vertical plane P that extends longitudinally through the center of the chair-bed 20. As such, only one folding mechanism 80 will be described herein, with the understanding that those skilled in the art will recognize that this discussion is equally applicable to the other folding mechanism 80 also.

Referring yet again to FIG. 3, the folding mechanism 80 includes a front backrest mounting bracket 82 that is mounted to a front portion of the underside of the panel 52. A carriage mounting bracket 84 is mounted to the inboard surface of the guide 68*a*. An angled drawing link 86 is attached via a pivot 87 to the front backrest mounting bracket 82 and extends rearwardly and downwardly therefrom to terminate at a pivot 88 with the carriage mounting bracket 84. A transition link 90 is attached via a pivot 91 to the vertex of the drawing link 86 and extends generally rearwardly therefrom.

Referring still to FIG. 3, a rear backrest mounting bracket 92 is mounted to a rear portion of the underside of the panel 52. A connecting link 94 is attached to the rear backrest mounting bracket 92 at a pivot 95 and extends downwardly and rearwardly therefrom. Also, the rear portion of the transition link 90 is attached to an intermediate section of the connecting link 94 at a pivot 96. A brace 98 is attached to the rearward end of the connecting link 94 at a pivot 99 and extends downwardly and slightly rearwardly therefrom. A front scissor link 100 is attached to the rear backrest mounting bracket 92 at a pivot 101 and extends rearwardly and slightly downwardly therefrom. In this embodiment, a rear scissor link 102 is directly interconnected via a pivot 103 to the center of the front scissor link 100. At its upper, rearward end, the rear scissor link 102 is attached via a pivot 105 to a rear support mounting bracket 104 that is mounted to the underside of the panel 42; at its forward, lower end, the rear scissor link 102 is attached via the pivot 99 to the connecting link 94 and the brace 98. Also, the lower edge of the upper end of the rear scissor link 102 rests against a pin 100*a* located on the front scissor link 100. This interaction maintains the mechanism 80 (and, in turn, the chair-bed 20) in the unfolded position of FIG. 3 and prevents the rear support 40 and the backrest 50 from rotation in which the cushions 44, 54 thereof face each other.

Referring once again to FIG. 3, a control link 106 is attached to the rear support mounting bracket 104 at a pivot 107 and extends forwardly and downwardly to terminate in a pivot 108 with the rear portion of the front scissor link 100. A support leg 110 is also attached to the rear support mounting bracket 104 at the pivot 107. The support leg 110 extends generally downwardly and slightly forwardly to a pivot 111 with the lower end of the brace 98, then downwardly from the pivot 111 to contact the underlying surface.

Figure 2:
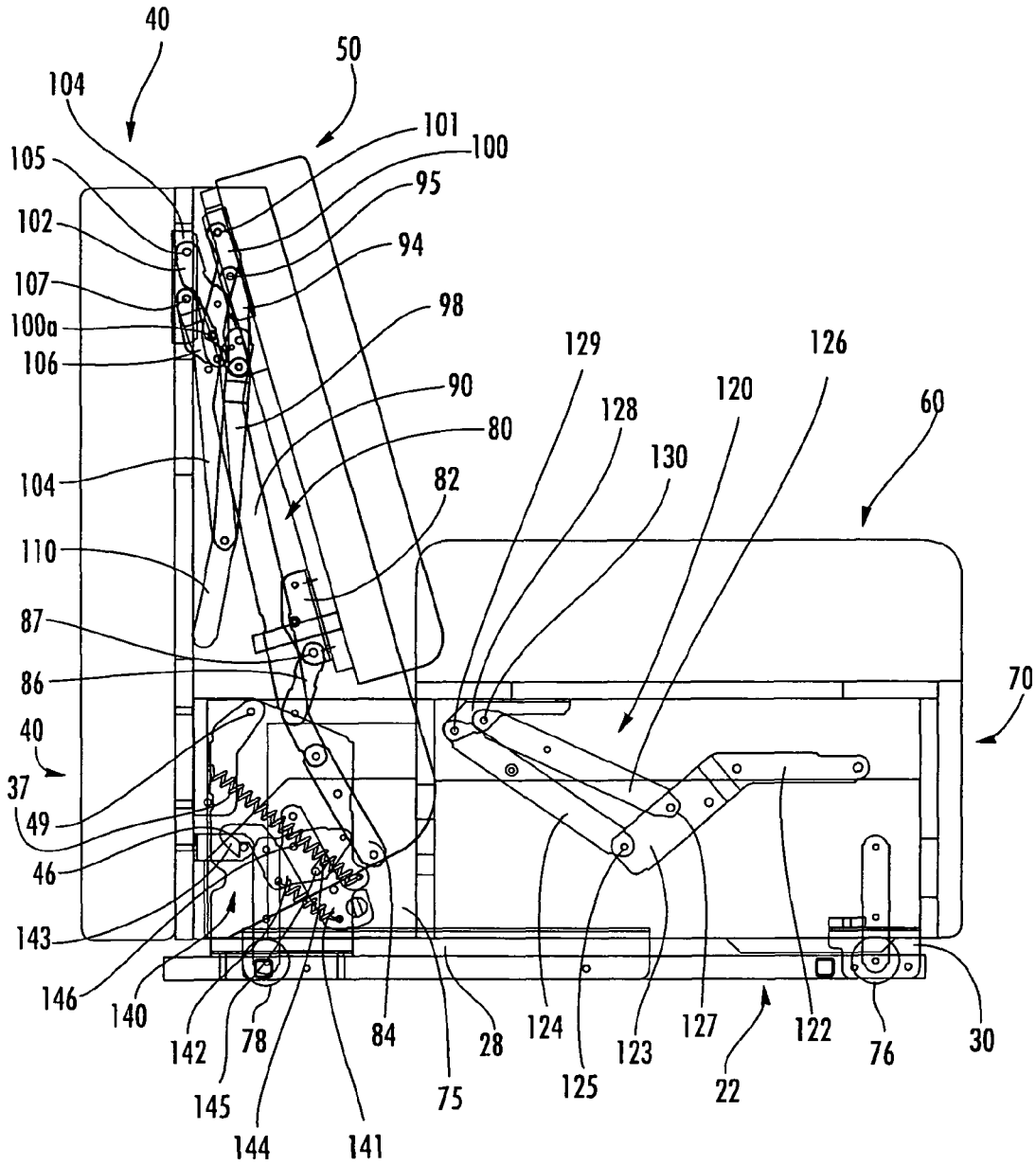
FIG. 2 is a side section view of the chair-bed of FIG. 1, with the chair-bed shown in the folded position.

To move the chair-bed 20 from the unfolded position of FIG. 3 to the folded position of FIG. 2, an operator applies an upwardly-directed force to the forward end of the rear support 40. Such a force causes the rear support 40 to pivot relative to the base 22 about the pivot 49 (counterclockwise from the vantage point of FIG. 3). As the rear support 40 pivots, the rear scissor link 102 and the control link 106 rise and rotate clockwise (from the vantage point of FIG. 3) relative to the rear support mounting bracket 104 about, respectively, the pivots 105, 107. As these links 102, 106 rotate and rise, they draw the front scissor link 100 and the connecting link 94 upwardly. This movement also drives the rearward end of the backrest 50 upwardly, and further causes the links 100, 94 to rotate counterclockwise relative to the rear backrest mounting bracket 92 about, respectively, the pivots 101, 95. The rotation of the connecting link 94 draws the rear end of the transition link 90 upwardly. This motion drags the drawing link 86 rearward, but rotates it counterclockwise relative to the front backrest mounting bracket 82 about the pivot 87. The general rearward motion of the drawing link 86 also draws the carriage mounting bracket 84 rearward, which in turn impels the seat carriage 70 and the attached seat 60 to roll rearwardly to the folded position shown in FIG. 2.

During the movement between the folded and unfolded positions, the rear edge of the backrest 50 and the front edge of the rear support 40 separate and form a gap therebetween. The arrangement of the folding mechanism 80 (and the absence of a simple hinge or the like directly pivotally interconnecting the backrest 50 and the rear support 40 enables the rear edge of the backrest 50 and the front edge of the rear support 40 to meet in the unfolded and folded positions, without any portion of the folding mechanism 80 being exposed.

Referring again to FIG. 3, as the rear scissor link 102 rotates about the pivot 105 in the manner described above, it drives the brace 98, and in turn the support leg 110, rearwardly, such that the support leg 110 rotates clockwise relative to the rear support mounting bracket 104 about the pivot 107. This movement enables the support leg 110 to fold between the panels of the rear support 40 and the backrest 50.

Motion ceases when the lower edge of the rear scissor link 102 contacts the pin 100*a* (see FIG. 2). In this position, the rear support 40 is generally upright with the cushion 44 facing rearwardly, the backrest 50 is generally upright (typically canted at an angle of between about 90 and 120 degrees to the underlying surface) and positioned forwardly of the rear support 40, with the cushion 54 facing generally forwardly, the seat 60 is generally horizontal and positioned forwardly of the backrest 50, with the cushion 64 facing upwardly, and the seat carriage 70 is positioned above the base 22 and below the seat 60. The folding mechanism 80 is largely contained between the rear support 40 and the backrest 50.

Figure 6:
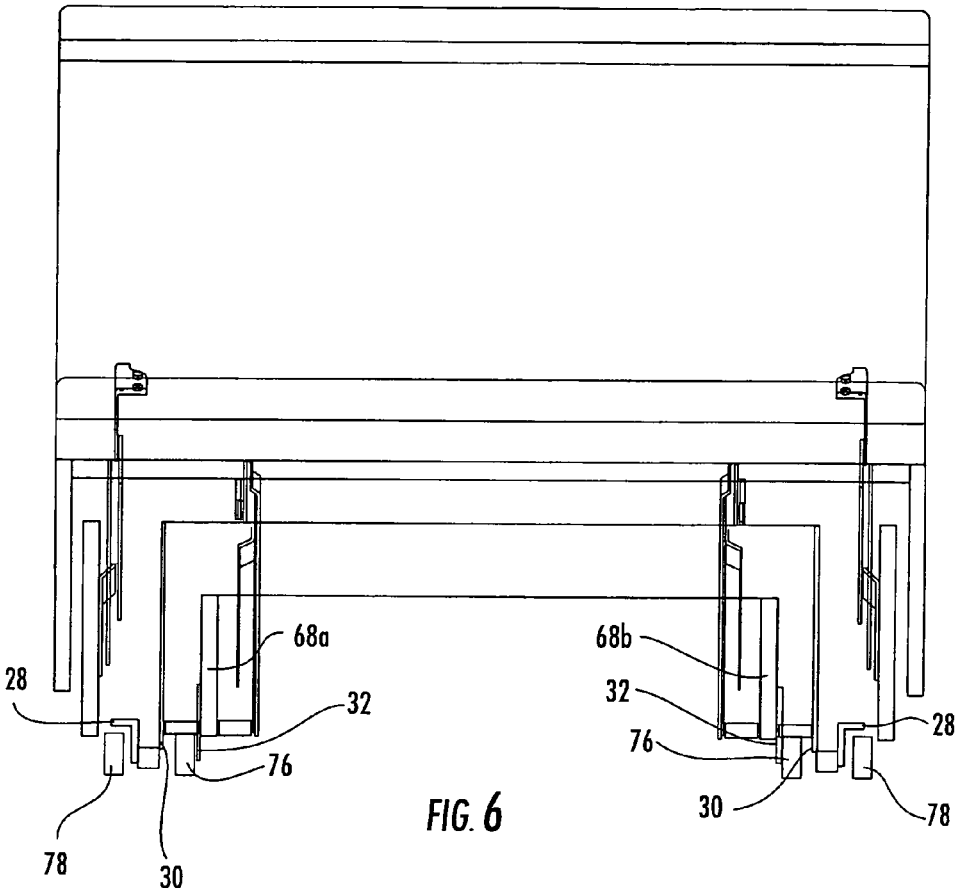
FIG. 6 is a front view of the chair-bed of FIG. 1.

In the illustrated embodiment, when the chair-bed 20 is moving to the folded position the front wheels 76 of the seat carriage 70 roll to a position just forward of the rollers 32 and below the upper surface of the front wheel shields 30. The rear wheels 78 roll to a position that is below the rear wheel shields 28. Each set of front and rear wheels 76, 78 are positioned in opposite transverse sides of the side rails 24*a*, 24*b* (see FIG. 6), which can reduce the degree of "slop" in the chair-bed 20 in the folded position and reduce the risk of it opening inadvertently (particularly when being moved). Also, the guides 68*a*, 68*b* engage and are assisted by the rollers 32 as they move rearwardly with the seat carriage 70, thereby facilitating smooth folding of the chair-bed 20.

As described, the chair-bed 20 can provide a seating unit or a bed, and can do so without either the rear support 40 or the base 22 having arms. This configuration may be particularly desirable for health care use, as arms are discouraged for safety reasons.

Figure 2A:
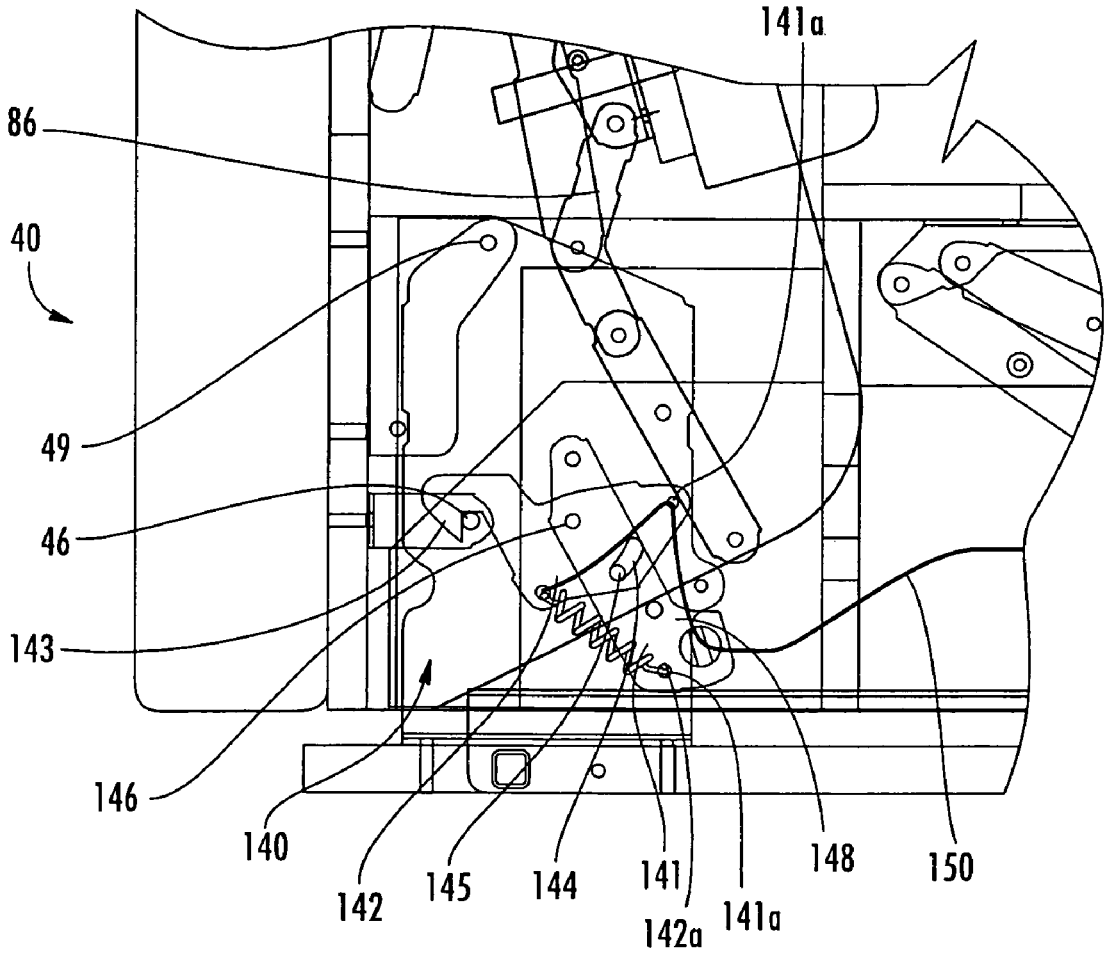
FIG. 2A is an enlarged side section view of the locking mechanism of the chair-bed of FIG. 1.

In the illustrated embodiment, the chair-bed 20 is maintained in the folded position by an optional releasable locking mechanism 140 (see FIG. 2A). The locking mechanism 140 includes a mounting plate 141 that is fixed to the central support 75 of the seat carriage 70 and a locking plate 142 that is pivotally mounted to the mounting plate 141 at a pivot 146. The locking plate 142 includes a hook 143 at its rearward end. A slot 144 in the locking plate receives a pin 145 mounted to the mounting plate 141. A spring 148 extends between a hole 141*a* in the mounting plate 141 and a hole 142*a* in the locking plate 142. A cable 150 is attached to the forward end of the locking plate 142 and extends to a position within the storage cavity 74 of the carriage 70 to an actuator (not shown).

When the chair-bed 20 is in the folded position, the hook 143 engages the pin 46 of the base 22, and the locking plate 142 is rotated such that the pin 145 is received in the lower, rearward end of the slot 144. The spring 148, which is in tension, biases the locking plate 142 to maintain the hook 143 in engagement with the pin 46, which in turn maintains the chair-bed 20 in the folded position. When tension is applied to the cable 150 through the actuator 152, the locking plate 142 rotates clockwise (from the vantage point of FIG. 2A) until the hook 143 "clears" the pin 46. At this point the seat carriage 70 can be rolled forwardly (controlled by the folding mechanism 80) to unfold the chair-bed 20. When the chair-bed 20 is returned from the unfolded position to the folded position, the hook 143 deflects upwardly when it strikes the pin 46 during its rearward movement, then recovers to an engaged position due to the biasing of the spring 148. Thus, the locking mechanism 140 can maintain the chair-bed 20 in the closed position, which can simplify relocation of the chair-bed 20 and can prevent unwanted unfolding of the chair-bed 20.

In addition, the illustrated chair-bed embodiment includes, as an optional feature, a pair of mirror image seat lifting mechanisms 120 (only one of which will be described herein) that provides access to the storage cavity 74 located within the seat carriage 70. Referring to FIG. 2, the seat lifting mechanism 120 includes a mounting bracket 122 that is fixed to the inner surface of the side walls 72*a*, 72*b*. A rear swing link 124 is mounted to the rear end of a finger 123 of the mounting bracket 122 at a pivot 125, and a front swing link 126 is mounted to a more forward portion of the finger 123 at a pivot 127. A seat mounting bracket 128 is fixed to a rear portion of the underside of the panel 62. The rear and front swing links 124, 126 are pivotally attached to the seat mounting bracket 128 at, respectively, pivots 129, 130.

Figure 4:
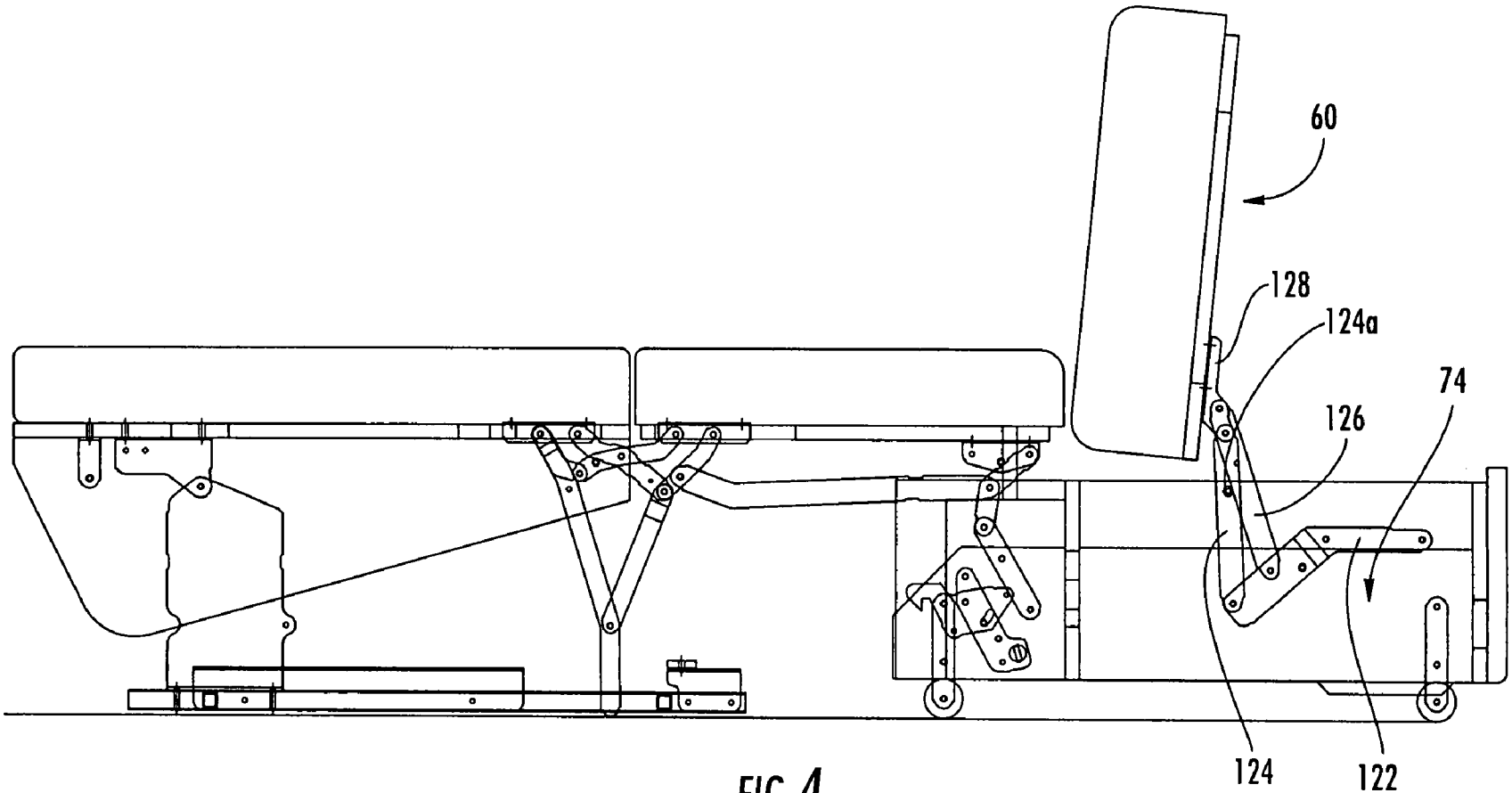
FIG. 4 is a side section view of the chair-bed of FIG. 1, with the chair-bed shown in the unfolded position and the seat shown in an access position.

The seat 60 can be moved between a closed position (FIG. 2), in which the seat 60 is generally horizontal and covers the storage cavity 74, and an open position (FIG. 4), in which the seat is generally upright and permits access to the storage cavity 74. In the closed position, both of the rear and front swing links 124, 126 extend upwardly and rearwardly from their respective pivots 125, 127 with the mounting bracket 122. As the forward end of the seat 60 is lifted, each of the swing links 124, 126 rotates clockwise relative to the mounting bracket 122, which in turn lifts and rotates counterclockwise the seat mounting bracket 128 and the attached seat 60. Motion ceases when the front swing link 126 strikes a pin

124*a* on the rear swing link 124. When the seat 60 is in the open position, the storage cavity 74 can be accessed for the storage of items, such as bedclothes and pillows for the bed itself.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A seating unit convertible into a bed, comprising:

a base configured to rest on an underlying surface;

a rear support pivotally interconnected with the base, the rear support having a rear support cushion that faces rearwardly in the folded position;

a backrest having a backrest cushion;

a seat having a seat cushion;

a seat carriage; and a folding mechanism attached to the rear support, backrest and seat, the folding mechanism comprising a plurality of pivotally interconnected links that are configured and arranged to move the rear support, backrest and seat between a folded position, in which the rear support is generally upright, the backrest is generally upright and positioned forwardly of the rear support, the seat is generally horizontal and positioned forwardly of the backrest, and the seat carriage is positioned above the base and below the seat, and an unfolded position, in which the rear support, the backrest, and the seat are substantially horizontal and serially aligned with each other, the rear support is above the base, and the seat carriage is positioned below the seat and forward of the base;

wherein the folding mechanism includes a folding leg that resides between the rear support and the backrest in the folded position and that rests directly on the underlying surface in the unfolded position; and wherein the rear support cushion is exposed to the rear when the seating unit is in the folded position.

2. The seating unit defined in claim 1, wherein the backrest cushion faces generally forwardly in the folded position, and the seat cushion faces upwardly in the folded position.

3. The seating unit defined in claim 1, wherein the rear support is directly pivotally interconnected with the base.

4. The seating unit defined in claim 1, wherein the seat carriage includes wheels that roll on the underlying surface as the seating unit moves between the folded and unfolded positions.

5. The seating unit defined in claim 4, wherein the base includes a longitudinally-extending rail, and wherein the seat carriage includes a front wheel and a rear wheel, and wherein, in the folded position, the front wheel is positioned on one transverse side of the rail, and the rear wheel is positioned on the other transverse side of the rail.

6. The seating unit defined in claim 1, wherein the folding mechanism includes a front scissor link pivotally interconnected with the backrest, and a rear scissor link pivotally interconnected with the rear support and with the front scissor link.

7. The seating unit defined in claim 6, wherein the front scissor link and the rear scissor link are directly pivotally interconnected.

8. The seating unit defined in claim 1, wherein the folding mechanism is configured such that a front edge of the rear support and a rear edge of the backrest are adjacent to each other in the folded and unfolded positions, and that a gap forms between the front edge of the rear support and the rear edge of the backrest as the seating unit moves between the folded and unfolded positions.

9. The seating unit defined in claim 1, further comprising a locking mechanism that releasably locks the seating unit into the folded position.

10. The seating unit defined in claim 1, wherein the folding leg is pivotally attached to the rear support.

11. The seating unit defined in claim 1, wherein the seat carriage includes a storage cavity.

12. The seating unit defined in claim 11, wherein the seat is pivotally interconnected with the seat carriage and is movable between a closed position, in which the seat is generally horizontally disposed and covers the storage cavity and prevents access thereto, and an open position, in which the seat is generally upright and allows access to the storage cavity.

13. The seating unit defined in claim 11, further comprising a locking mechanism that releasably locks the seating unit into the folded position, and wherein an actuator for the locking mechanism is accessible from the storage cavity.

14. The seating unit defined in claim 1, wherein the seating unit is a chair.

15. A seating unit convertible into a bed, comprising:

a base configured to rest on an underlying surface;

a rear support pivotally interconnected with the base;

a backrest having a backrest cushion;

a seat having a seat cushion;

a seat carriage; and a folding mechanism attached to the rear support, backrest and seat, the folding mechanism comprising a plurality of pivotally interconnected links that are configured and arranged to move the rear support, backrest and seat between a folded position, in which the rear support is generally upright, the backrest is generally upright and positioned forwardly of the rear support, the seat is generally horizontal and positioned forwardly of the backrest, and the seat carriage is positioned above the base and below the seat, and an unfolded position, in which the rear support, the backrest, and the seat are substantially horizontal and serially aligned with each other, the rear support is directly above the base, and the seat carriage is positioned below the seat and forward of the base;

wherein the folding mechanism is configured such that a front edge of the rear support and a rear edge of the backrest are in gapless contact with each other in the folded and unfolded positions but separate from each other as the rear support and backrest move between the folded and unfolded positions, and wherein the folding mechanism is devoid of a hinge that directly pivotally interconnects the rear support and the backrest.

16. A seating unit convertible into a bed, comprising:

a base configured to rest on an underlying surface;

a rear support pivotally interconnected with the base;

a backrest having a backrest cushion;

a seat having a seat cushion;

a seat carriage having a storage cavity; and a folding mechanism attached to the rear support, backrest and seat, the folding mechanism comprising a plurality of pivotally interconnected links that are configured and arranged to move the rear support, backrest and seat between a folded position, in which the rear support is generally upright, the backrest is generally upright and positioned forwardly of the rear support, the seat is generally horizontal and positioned forwardly of the backrest, and the seat carriage is positioned above the base and below the seat, and an unfolded position, in which the rear support, the backrest, and the seat are substantially horizontal and serially aligned with each other, the rear support is above the base, and the seat carriage is positioned below the seat and forward of the base; and wherein the seat can be moved away from the seat carriage for accessing the storage cavity via a seat lifting mechanism comprising a plurality of pivotally interconnected links, the seat lifting mechanism enabling the seat to move from a closed position over the seat carriage to an open position in which the seat is generally upright and permits access to the storage cavity, the seat lifting mechanism including a rear swing link that is pivotally interconnected with the seat and the seat carriage, and further including a front swing link that is pivotally interconnected with the seat and the seat carriage.

17. The seating unit defined in claim 15, wherein the backrest cushion faces generally forwardly in the folded position, and the seat cushion faces upwardly in the folded position.

18. The seating unit defined in claim 15, wherein the seat carriage includes wheels that roll on the underlying surface as the seating unit moves between the folded and unfolded positions.

19. The seating unit defined in claim 15, wherein the folding mechanism includes a front scissor link pivotally interconnected with the backrest, and a rear scissor link pivotally interconnected with the rear support and with the front scissor link.

20. The seating unit defined in claim 15, further comprising a locking mechanism that releasably locks the seating unit into the folded position.

* * * * *